US007363936B1

(12) United States Patent
Simoneaux et al.

(10) Patent No.: US 7,363,936 B1
(45) Date of Patent: Apr. 29, 2008

(54) LEAKAGE CATCH BASIN AND CONFIGURABLE STORAGE UNIT

(75) Inventors: Brad Simoneaux, Austin, TX (US); Tom J. LeBlanc, McKinney, TX (US)

(73) Assignee: Logical Products, Inc., Plano, TX (US)

( * ) Notice: Subject to any disclaimer, the term of this patent is extended or adjusted under 35 U.S.C. 154(b) by 392 days.

(21) Appl. No.: 11/075,623

(22) Filed: Mar. 9, 2005

(51) Int. Cl.
*E03B 7/07* (2006.01)

(52) U.S. Cl. ..... 137/312; 220/23.4; 220/23.8; 220/533; 4/251.1

(58) Field of Classification Search ..... 4/251.1; 220/23.8, 533, 23.4, 23.86; 137/312; 47/85; 312/229
See application file for complete search history.

(56) References Cited

U.S. PATENT DOCUMENTS 2,985,333 A * 5/1961 Kirkman ..... 220/533
3,651,976 A * 3/1972 Chadbourne ..... 220/23.4
3,656,650 A * 4/1972 Frater ..... 220/533
3,856,369 A * 12/1974 Commiant ..... 220/23.4 X
3,920,144 A * 11/1975 Callen ..... 220/533
4,889,155 A 12/1989 Trotter, Sr.
4,903,723 A 2/1990 Sublett
5,199,457 A * 4/1993 Miller ..... 137/312
5,883,300 A 3/1999 Johnson
2002/0023293 A1* 2/2002 Lewis ..... 4/251.1

* cited by examiner

*Primary Examiner*—Robert M. Fetsuga
(74) *Attorney, Agent, or Firm*—Dykema Gossett PLLC

(57) ABSTRACT

Disclosed herein is my invention of a leakage catch basin and configurable storage unit, designed to be water tight and made of water resistant material. My invention further includes mans to position dividers into the larger defined spaces, thus forming an arrangement of organized storage compartments. Further, my invention is dimensioned to be of various and common sized cabinets with the illustrated preferred embodiment showing a configuration of 3 such sizes in combination. My invention allows one or all such defined spaces to be separated into independent units for subsequent installation, use and protection in separate cabinets.

1 Claim, 4 Drawing Sheets

LEAKAGE CATCH BASIN AND CONFIGURABLE STORAGE UNIT

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISK APPENDIX

Not Applicable

BACKGROUND

1. Field of the Invention

This invention relates to devices used to catch leakage or spillage of liquids. Specifically, my device relates to devices that collect leakage or spills/drips such as those occurring from a typical household sink and its associated plumbing and/or spills from wet items stored within a sink cabinet such as those used in household cleaning. My invention also relates to leak catching devices as they are applied to a variety of commonly sized cabinets. Further, my invention relates to devices that provide organization to items stored within a variety of commonly sized sink cabinets. Finally, my invention relates to a combination of the many features important to these prior mentioned fields but incorporated within a single device.

2. Description of the Prior Art

The configuration of a sink mounted within, and supported by, the top surface of a cabinet is well known and common. Virtually all homes and business have such sinks and the associated plumbing. Of particular interest is the cabinet that is used to support and position the sink, as well as to contain and conceal all the associated plumbing. This plumbing will of necessity include fittings, joints and pipes configured so as to supply water to the sink, and likewise fittings, joints and pipes configured so as to direct waste water and waste material away from the sink.

The typical design of kitchens, workrooms, bathrooms, washrooms, coffee break rooms, lunch rooms, etc. may include multiple sinks configured in close juxtaposition to one another. For example, most kitchen sinks in residential dwellings will include a minimum of 2 sinks joined together. A third smaller sink used specifically for food preparation and disposal is not uncommon. Each additional sink unit must of necessity include the plumbing related to that sink unit for water delivery and drain-water/waste removal.

Secondary plumbing configurations are also not uncommon within the confines of the same cabinet. For example, a dishwasher will almost always be located in close proximity to the sink cabinet and will typically source its water supply from the same plumbing as used by the sink. It will also most always tie its waste water plumbing into that used by the sink. These junctions and fittings are again configured and exist in the confines of space defined by the sink cabinet. Another common design feature offered for kitchens is a flexible hose with a spray head type fixture at it's upper end, the whole of which can be easily extended a distance from its holding position. Each of these items of course involves additional fittings, junctions and valves to be located within the cavity defined by the cabinet.

Another element of consideration is the installation of a garbage disposal unit in-line with the waste plumbing of the sink. Not only does this further add to and complicate the design and complexity of the enclosed plumbing, it typically introduces another factor not otherwise experienced by all the plumbing involved in the overall configuration (including all the fittings, junctions and joints for all sinks as well as secondary plumbing as described herein.) That factor is the vibration and movement, sometimes significant, that is caused by the operation of the disposal unit. This vibration will cause stress, vibration and movement to the plumbing and be of particular distress to each joint in the plumbing configuration.

So it is now shown that the environment within the cavity of a sink cabinet is one of complicated plumbing, which includes a multitude of joints (some of which are designed to be easily separated) that are subjected to forces that cause shaking and displacement. The potential of failure in any portion of the entirety of the plumbing is increased by each factor—the multitude of joints, the purposefully designed-in 'ease of disconnection' feature, and the disruptive motion inducing force of a disposal unit. Failure here is defined as a breach in the integrity of the plumbing configuration to fully and completely contain the enclosed liquid, thus allowing a drip or leak to occur.

Further, it's typical such cabinets will be used as storage space for containers whose contents are liquid, such as dish soap, cleaning agents for countertops and other surfaces, and plumbing maintenance liquids such as those used to unclog a drain. Along with those liquids, this space is commonly used to store cleaning utensils such as sponges, brushes and dish-rags which may themselves contain residual moisture following their intended use.

Finally, many cabinets are used to conceal a trash container, because it is easily concealed when the cabinet door is closed and because of the proximity to spaces typically being utilized for activities that result in refuse produced as a byproduct. An example is the cleaning and preparation of fresh food products. The arrangement of these stored items is arbitrary, random, changeable and lends itself to disarray. The cluttered assortment of containers and cleaning tools each have vastly different sizes, shapes and frequency of use. It is far too easy to just replace an article back into the lower cabinet space by merely setting in on the forward most edge and pushing all other articles backwards until the cabinet door has room to close.

The confines and inner surfaces of the cabinet are not easily visible, because the area is low, dark and concealed by its contents. As a result, the placement of any article into the cabinet for storage is made difficult. This results in the likelihood that any article once removed from the cabinet will be returned into a completely different position or space. This then contributes to the varied and changing arrangement of all things stored within the cabinet. It also contributes to the potential mis-alignment of moisture bearing refuse with the opening of the trash receptacle and subsequently spilling into the inner confines of the cabinet space.

Although not an exclusive design arrangement, it's typical for a sink to be installed into the top of a cabinet that has been specifically designed for that purpose. Cabinets will of necessity be of various and sizes for kitchens, baths, master baths, utility rooms, work rooms, etc. The vast majority of these cabinets will be made of wood or wood composite.

Therein lies the scenario for which my invention provides a solution.

Wood will deteriorate when wet. The potential sources of moisture within the confines of a sink cabinet constructed of wood are many. Each section of the entire plumbing configuration as described above involves the joining together of pipes, fittings, joints, flexible tubing and the like. Some of these joints are specifically designed to not be permanent but rather to allow easy disassembly by the home owner for maintenance. Each joint can be a source of moisture leakage. The storage of wet items is a source of moisture coming into contact with the cabinet structure. Additionally, a home owner or professional performing maintenance work such as the disassemble of a drain trap to unclog the drain can be a potential source of moisture. Finally, the storage of containers with liquids in them and articles used in cleaning activities are other sources of potential moisture.

This illustrates that the sources of potential moisture coming into contact with the cabinet surface are many and varied. However, the detection of that moisture is not made easy nor obvious. This is a result of the cabinet being well below the line of sight and it being dark within the confines of the cabinet. Additionally, there are many items within the cabinet that visually restrict any casual observation of leaks or existing moisture damage. These items include the things that are themselves the potential sources of moisture leakage, such as the plumbing and the many articles stored within the cabinet.

As a result, drips and leakage will go undetected for long periods of time. And of course the longer and more frequently the cabinet surfaces remain in contact with the moisture that is resulting from the leakage, the more extensive the damage becomes to the cabinet material. In extreme cases this damage can go beyond even the confines of the cabinet and extend into the flooring below it, and even into surfaces below the flooring, such as into the ceiling structure of a room positioned below an upstairs bathroom. It is easy to consider that the resulting damage and ensuing repair can be extensive, disruptive and expensive.

This demonstrates the need for a device such as I present here, including its many advantages.

The United States Patent and Trademark Office data contains prior art describing devices that address protection from leakage as well as prior art describing storage devices for cabinets, as included in my design. Even so, room for improvement exists in the usability, functionality, performance, safety and convenience of such designs over and beyond what prior art teaches.

One example of such prior art is Johnson, U.S. Pat. No. 5,833,300 titled "System and Method for Containing Fluid Leaks and Overflows from Appliances". Johnson describes a simply shaped catch basin with sides that reconfigure to allow the easy positioning of an appliance (most notably a dishwasher) onto and above his device.

Trotter, U.S. Pat. No. 4,889,155 titled "Water Collection Mat for Dish-Washers" teaches a similar device as Johnson, specific to use with a dishwasher, without the specifics of a folding arrangement of sides, and with the addition of an integrated drain.

Sublett, U.S. Pat. No. 4,903,723 titled "Collection Basin and Drain for Dishwasher Leakage" again teaches a design specific to use in conjunction with a dishwasher. In this case the appliance does not rest within the same volume provided for catching leakage as shown in the others, but rather its wheels straddle the outside of that structure and catch basin volume.

Each of these prior art examples contain merits that stand by themselves, but none exhibit the combination of features, ease of manufacture, cost effectiveness and functionality presented in my invention.

OBJECTS AND ADVANTAGES

The several objects and advantages of my invention present a device that is convenient in use, effective in operation, simple in design and manufacture, and functional in purpose. Specifically, my invention presents a basin configured to catch all sources of moisture leakage onto a cabinet, with the additional functionality that allows the arrangement and fixing of partitions in order to create organization for items stored in the same space, and finally having specific geometry so as to be easily customized for effective use within any commonly sized, precluding the manufacture and purchase of a larger number of devices, each of a specific size to fit only a single specific cabinet space of matching size.

The multi-use characteristics of the space defined by a typical sink cabinet requires a multi-function device to appropriately and completely address each of those characteristics. Any device addressing just one of the uses of the space does not assist with the other uses of the space. However, a holistic approach to addressing the enhancement of the complete range of diverse uses of the space will by definition improve each individual use as well as the complete range of uses.

My invention provides a means to contain leakage and moisture that otherwise will cause damage to the structural integrity of the cabinet. This leakage and moisture is a constant potential because of the very nature of the primary function of a typical sink cabinet—to support and position a sink (or sinks) and to contain and conceal the plumbing associated with that sink (or sinks). Whether this leakage is from a joint that needs repair, the removal of a portion of the plumbing to perform maintenance, or articles stored in the defined cabinet space, my invention will completely contain the leakage and prevent it from coming into contact with the cabinet surfaces.

My invention is molded and configured into sections so as to be easily separated by the user for application in many of the commonly sized cabinets so that only one design need be manufactured, marketed, packaged, shipped, warehoused, stocked and purchased by a consumer. This greatly minimizes the costs involved during the entire life cycle of the design. In certain combinations it further allows a consumer to satisfy 2 or 3 applications with purchase of but a single unit.

Another object and advantage of my invention is to provide for an organized storage of items underneath and within a cabinet space. The configurability of included dividers within any of several cavities specifically molded in place for holding such a divider, allows the user to define the exact size, number and arrangement of storage spaces any user needs for arranging items. The dividers are held fast in the cavities until the user wishes to remove them for re-configuration of the array of spaces. Thus the design of my invention not only provides for definition of efficient storage spaces, it provides for a re-definition of those storage spaces to flex with the changing needs of the user. This repeated redefinition of the spaces can be performed an unlimited number of times and at anytime during the useful life of my invention.

This design feature of my invention that provides for an organized arrangement of spaces also eases the activities related to those items stored. It supports the repeated storage of an item in the same place for ease of finding each time it's needed, and encourages the replacement of each item in its 'assigned' space so the collection of items does not tend to get into a disarray. This in turn minimizes the risk of any such item tipping over and causing spillage. The repeatability of storing items in the same place also supports the ease by which any particular item can be located for use. Thus, the user does not have to rummage about between many items stored, potentially tipping over one or several bottles, which again causes spillage onto the cabinet surfaces.

The simple design of my invention supports the low cost of manufacturing of the article itself, and does not require the development of any new material or manufacturing processes. It can be manufactured from a variety of water resistant materials, each in existence today with well known and documented formulary, supply sources, design parameters, characteristics and manufacturability. An example would be thermo-plastics or rubber compounds that can be injection molded, poured or otherwise formed and shaped using well known manufacturing processes and facilities. The flexibility of the materials used to construct my invention also supports the ease of inserting it into a cabinet space and subsequently removing it from the same space for cleaning or re-application into another space.

Further, the geometry and design of my invention supports a simple packaging of several units by nesting together many one on top of another. This maximizes the number of units a distributor can store in a limited amount of warehouse space. The design also allows a simple marketing of the device for the retail application because it requires virtually no protective packaging. Nor does it require extensive instructions for use, limited primarily to the graphical illustration of the means to separate the single unit into multiple units if so desired, and the insertion/removal of the provided dividers to define the desired storage configuration.

Further objects and advantages of my invention will become apparent from a consideration of the drawings and ensuing description.

SUMMARY OF THE INVENTION

A tray device that captures leakage from plumbing, wet articles and containers, having a geometry that allows fitment into one or more common cabinet sizes by separating specific sections, and that has reposition-able dividers used to define and partition the larger space into useable and functional smaller spaces.

DESCRIPTION OF THE INVENTION

Figure 1:
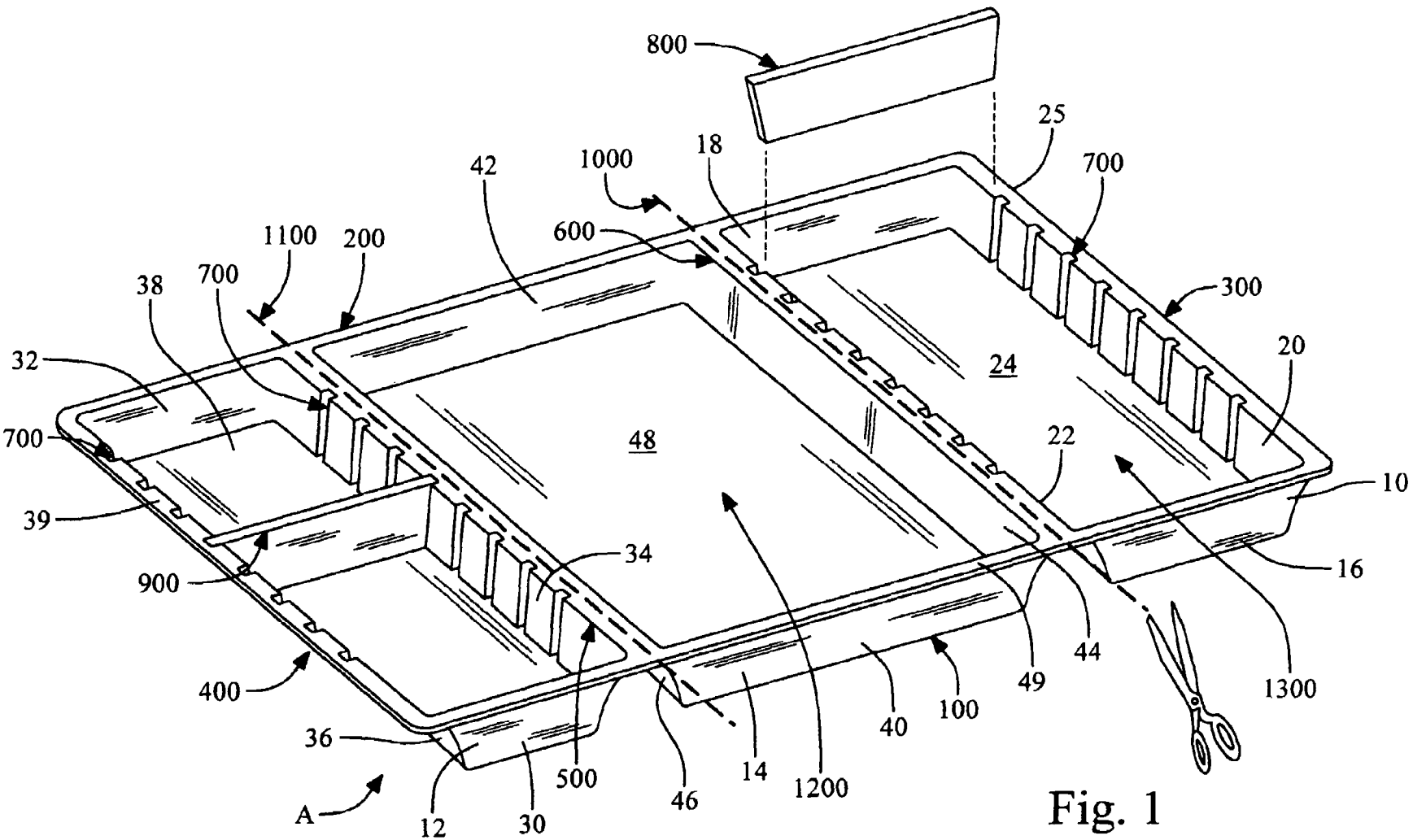
FIG. 1 is a top perspective view of the preferred embodiment of the leakage catch basin and configurable storage unit.
Figure 2:
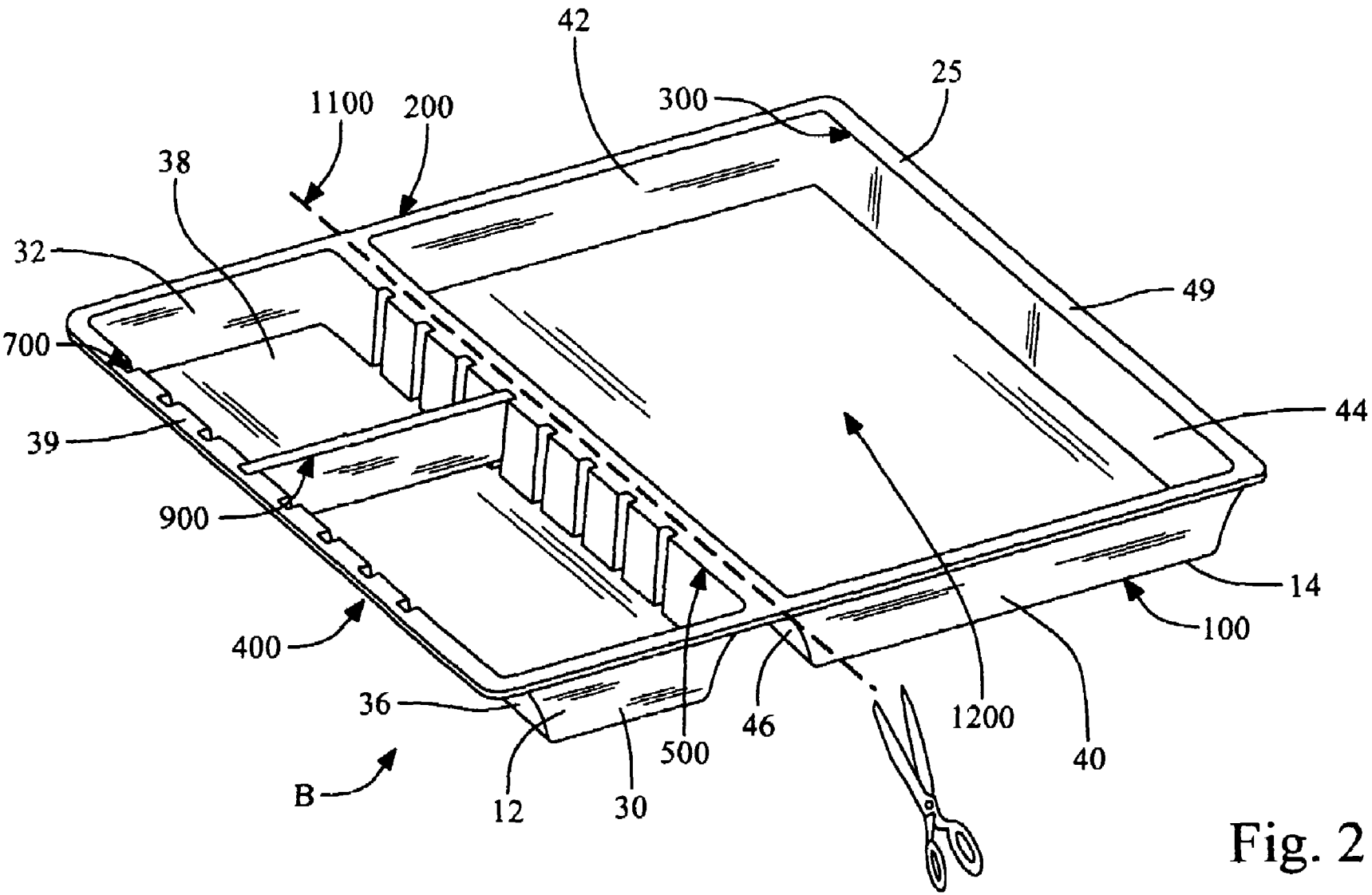
FIG. 2 is a top perspective view of an alternate embodiment of the leakage catch basin and configurable storage unit.
Figure 3:
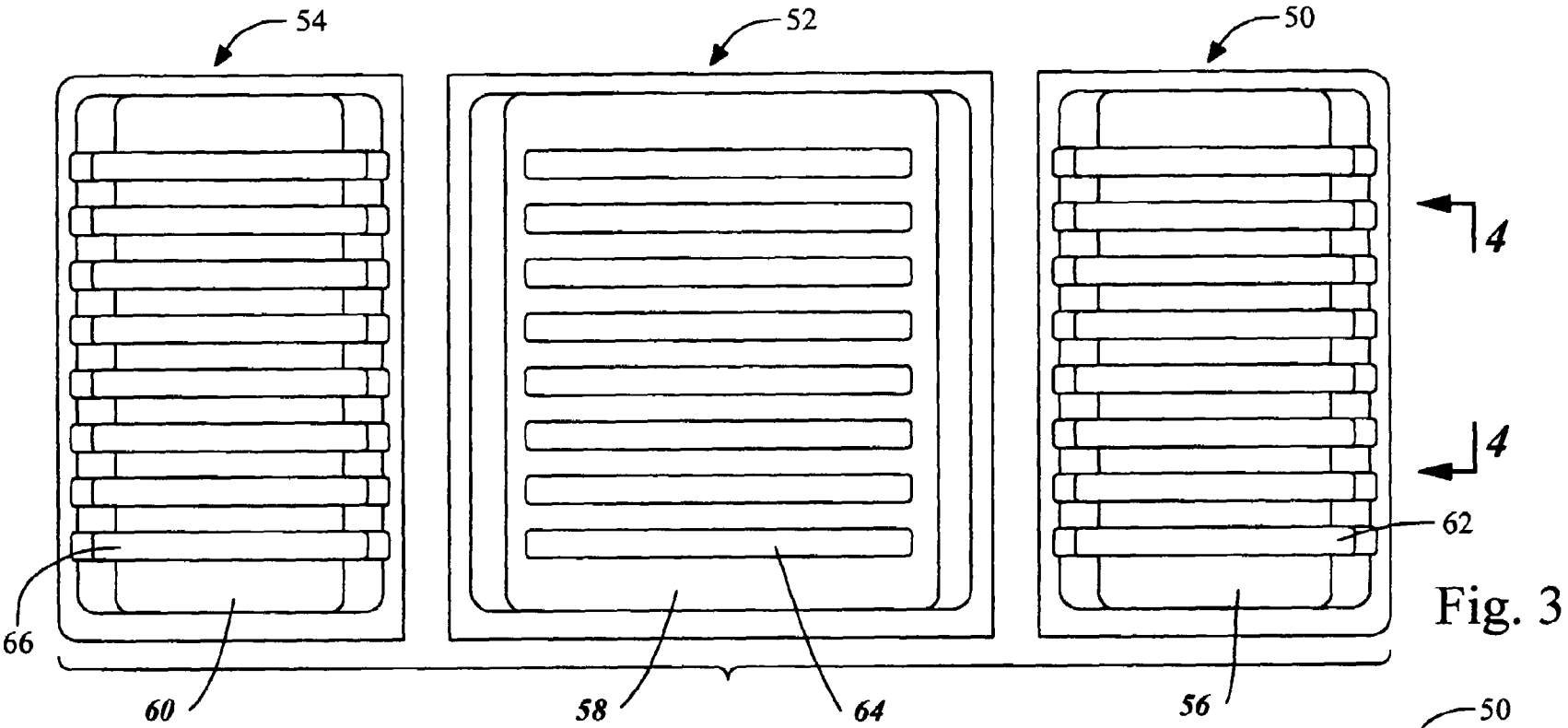
Figure 4:
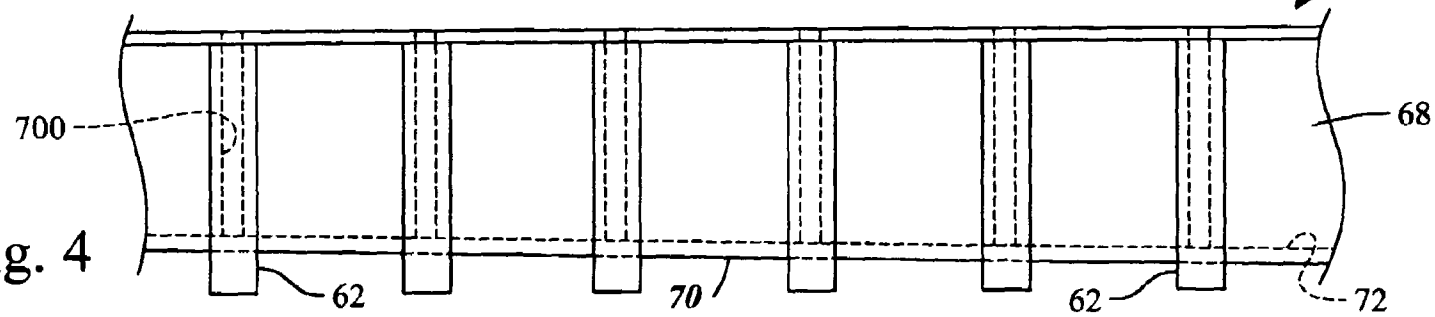
Figure 5:
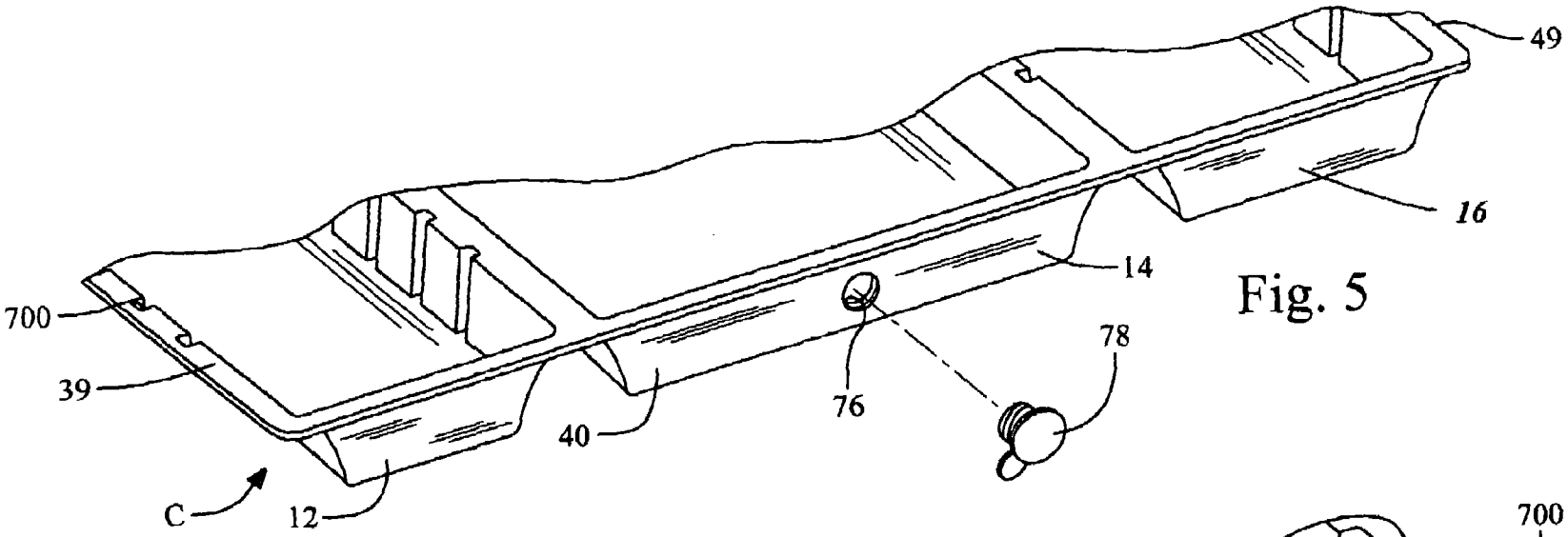
Figure 7:
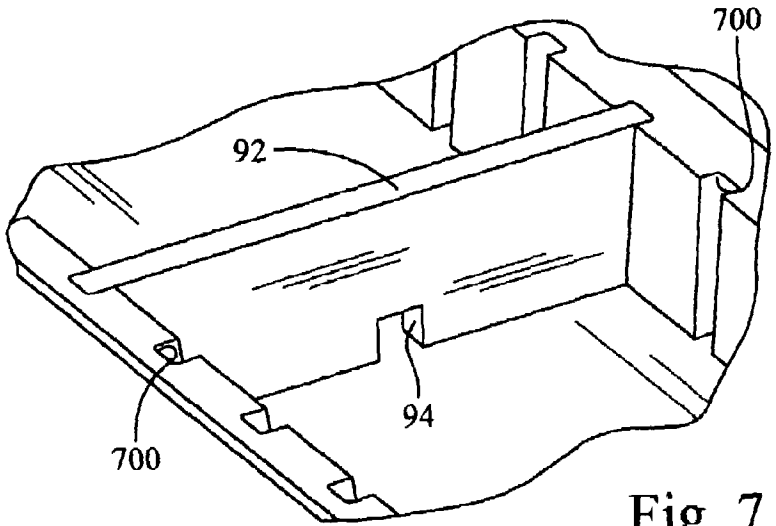
Figure 6:
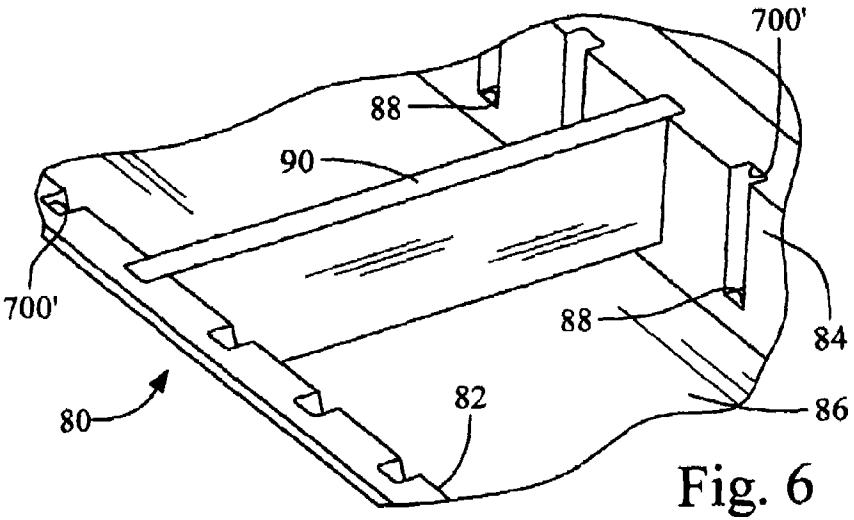

FIG. 1 shows the preferred embodiment of the Leakage Catch Basin and Configurable Storage Unit. FIG. 2 shows an alternate embodiment of the Leakage Catch Basin and Configurable Storage Unit, having a lessor number of inner volumes.

The invention is a single piece of formed material with a number of separate dividers that can be positioned to define specific storage spaces. The material used is waterproof, and even after being shaped the resulting unit remains watertight. It is specifically shaped so as to support the separation along one or more defined axis lines to divide into two or more fully functional units that can be positioned within separate and distinct cabinets that may be of various and common sizes.

The design of the invention provides for multiple functions to be accommodated from a single device. The invention protects the cabinet material from plumbing leaks and other sources of moisture, thus avoiding the ensuing rot or decomposition of the actual cabinet material. Further, the invention provides for easy separation from a single shape into multiple shapes for use in other cabinets. The invention also provides for the definition and/or reconfiguration of smaller spaces defined within the overall larger space, providing compartments of a size specific to the articles stored within the cabinet. This feature eases the organization and use of these articles, and lessens the probability of accidental spillage of liquid from these articles.

A shape is formed by the roughly orthogonal juxtaposition of Front Wall 100, Rear Wall 200, Right Wall 300 and Left Wall 400. The front wall 100 has first, second, and third interconnected front wall sections or panels 16, 30 and 40 as in FIG. 1. The rear wall 200 has first, second and third interconnected rear wall sections or panels 18, 32 and 42. The front wall 100 and the rear wall 200 are configured roughly parallel to each other. Left Inner Wall 500 and Right Inner Wall 600 run between Front Wall 100 and Rear Wall 200. The distances separating Left Inner Wall 500 and Right Inner Wall 600 from each other as well as from Right Wall 300 and Left Wall 400 are specific distances so as to define a combination of Inner Volumes 1200 suitable for use in various and common sized cabinets. The right wall 300 and left wall 400 are configured roughly parallel to each other and at right angles to the front wall 100 and rear wall 200.

Bottom Surface 1300 runs beneath each Inner Volume 1200 and its connected seamlessly along its edges to Front Wall 100, Rear Wall 200, Right Wall 300 and Left Wall 400.

A series of Pockets 700 are formed along the length of Right Wall 300 and aligned with similar Pockets 700 along Right Inner Wall 600. This configuration is repeated along the length of Left Wall 400 and Left Inner Wall 500. Right Divider 800 and Left Divider 900 are removably insertable into any of the opposing series of Pockets 700 resulting in a division of each Inner Volume 1200 into a variety of user definable sizes that can be used for storage of differently sized articles. Each divider is of the same height as the length of each pocket 700.

The Leakage Catch Basin and Configurable Storage Unit A of FIG. 1 may be used in whole or may be easily separated along Right Cut Line 1000 and/or Left Cut Line 1100 and each resulting Inner Volume 1200 can thus be independently placed into other cabinets of various and common sizes.

When the storage unit A is separated, three elongated open top container trays designated herein as the first tray 10, second tray 12 and the third tray 14 which is located between trays 10 and 12. The third tray 14 has a larger volume than the first and second trays 10 and 12 which are of equal volumes.

The first tray 10 has four upstanding panels including a front panel 16, a rear panel 18, and right hand side panel 20, a left hand side panel 22 and a flat bottom panel 24. A series of formed pockets 700 are located in the right hand side panel 20 and in the left hand side panel 22. The pockets 700 are longitudinally aligned along each panel 20, 22, with pockets 700 in each panel being located opposite the pockets 700 in the other panel. The upper edges of the upstanding panels 16, 18, 20 and 22 are provided with a continuous outwardly extending flange or rim 25 of generally uniform thickness.

The second tray 12 has four upstanding panels, including a front panel 30, a rear panel 32, a right hand side panel 34, a left hand side panel 36, and a flat bottom panel 38. A series of formed pockets 700 are located in the right hand side panel 34 and in the left hand side panel 36. As with the pockets 700 in the first tray 10, the pockets 700 in each side panel of the second tray 12 are also longitudinally aligned, with pockets in each side panel being located opposite the pockets 700 in the other panel. The upper edges of upstanding panels 30, 32, 34 and 36 are provided with a continuous outwardly extending flange or rim 39 of generally uniform thickness. The pockets 700 formed in the first and second trays 10, 12 are elongated and extend vertically. The pockets 700 are of relatively narrow and uniform width throughout their longitudinal extent.

The third tray 14 is larger in size and in volume than trays 10 and 12. It includes four upstanding panels including a front panel 40, a rear panel 42, a right side panel 44, a left side panel 46 and a flat bottom panel 48. The inside surfaces of upstanding panels 40, 42, 44 and 46 are smooth, without any pockets as illustrated in FIG. 1. The upper edges of upstanding panels or walls 40, 42, 44, and 46 are provided with a continuous outwardly extending flange or rim 49 of generally uniform thickness. The front wall 100, right hand wall 300, rear wall 200, left hand wall 400 and the first and second pairs of interior walls 34, 46 and 44, 22 are of the same height. The continuous flanges 25, 39 and 49 are of uniform thickness around the peripheries of trays 10, 12 and 14 respectively. The right cut line 1000 is located on the top surface of the pair of inner walls 44, 22 while the left cut line 1100 is located on the top surface of the pair of inner walls 34, 46.

As referred to previously, right divider 800 and left divider 900 are removably insertable into any of the opposing series of pockets 700 of trays 10 and 12 respectively as illustrated in FIG. 1.

The leakage catch basin and configurable storage unit B of FIG. 2 is an alternate embodiment comprising only the second and third trays 12 and 14. Like numbers, as in FIG. 1, are used in FIG. 2 to illustrate the various panels. The flanges or rims are designated 39' and 49'.

OPERATION OF INVENTION

Operation of the Leakage Catch Basin and Configurable Storage Unit is intuitive and simple. Upon determination of the number and width of cabinet spaces the user wishes to protect from moisture damage and/or store potentially spillable articles in, a cut is made along either Right Cut Line 1000 or Left Cut Line 1100 or both. The resulting partitioned segments of the once whole Leakage Catch Basin and Configurable Storage Unit are inserted into each ensuing cabinet space. Right Divider 800 and/or Left Divider 900 or a series of either are then positioned into opposing Pockets 700 as desired. Note that while FIG. 1 is an illustration of the preferred embodiment of the Leakage Catch Basin and Configurable Storage Unit, and as such includes only a single Right Divider 800 and Left Divider 900, in practice a multitude of dividers may be utilized to form what spaces are deemed appropriate by the user.

OTHER EMBODIMENTS OF THE INVENTION

Other embodiments of the Leakage Catch Basin and Configurable Storage Unit include but are not limited to:

A design with only a single Inner Volume 1200;

A design with two Inner Volume 1200's and a single inner separating wall such as Left Inner Wall 500;

A design including more or fewer series of Pockets 700, for instance positioned to allow separation of any Inner Volume 1200 as defined in FIG. 1;

A design with 4 or more Inner Volume 1200's defined by additional inner walls;

Inclusion of a draining hole with plug near the lower edge of Front Wall 100 to ease the removal of larger quantities of spilled liquid;

A design that includes formed and raised ridges along Bottom Surface 1300 to elevate the lower extremity of stored articles above the potentially moistened Bottom Surface 1300 and any potential liquid spilled and contained within Inner Volume 1200;

Cutouts along the lower extremity of any included divider to allow for passage of leakage into the greater defined Inner Volume 1200 to avoid the overfilling of any single smaller space defined by placement of a divider;

Perforations formed in the material along any intended separation line to ease the process of achieving that separation;

A design with Bottom Surface 1300 slanted down slightly toward Front Wall 100 to direct any leakage toward Front Wall 100, thereby making that leakage visible more easily and sooner, thus altering the user that leakage has occurred; and A design of Pocket 700 that does not allow any divider to come into full contact with Bottom Surface 1300, thereby allowing the flowing of spillage into the greater Inner Volume 1200 and potentially, when used in conjunction with a forward facing drain in Front Wall 100, allowing the drainage of liquid without removal of stored articles nor removal of the Leakage Catch Basin and Configurable Storage Unit from the cabinet.

CONCLUSION, RAMIFICATION AND SCOPE OF INVENTION

The reader can surmise from the material herein presented that the invention provides enhancements to prior art in the field of leakage or spillage of fluids, as well as prior art in the field of devices that can be utilized in a multitude of various and common sized cabinets, and finally to the prior art in the field of devices combining such functionality with storage organization and being present all in one article of invention.

My invention can be applied to cabinets of varying size and shape. The integrity of the underlying material comprising the cabinet is secured from damage resulting from contact with moisture. Likewise, surrounding structures such as flooring, support beams, and lower level ceilings are protected.

Containers and articles can now be organized using the included dividers and many pockets to support those dividers, positioning each divider into a pair of pockets where the resulting defined space provides the maximum of function and usability. Each divider is easily and quickly removed and re-positioned into another pair of pockets to redefine the space as required, accommodating the changing needs of the user.

All materials contemplated in the construction of my device are readily obtainable by one versed in the field, and are of reasonable expense. They are common materials that support easy manufacture, manipulation and use.

Although the description above contains many specifics, these should not be construed as limiting the scope of the invention but as merely providing advantages of some of the presently preferred embodiments of my invention. For instance, the number of inside walls forming separated volumes can vary such that 1 or many volumes are defined. The location and number of pockets designed to hold the dividers can vary so more or fewer separate storage areas can be defined. There may be variations in the bottom surface, such as a sloping surface or a ridged surface. The dividers themselves may be designed to allow flow of leakage into an adjoining space. There may be one or several drain openings in the outer walls.

Accordingly, the scope of the invention should be determined not by the embodiment(s) illustrated or described, but by the appended claims and their legal equivalents.

What is claimed is:

1. A leakage catch basin and configurable storage unit with first, second and third interconnected elongated open top container trays comprising:

a front wall, defined by first, second and third interconnected front wall sections;

a rear wall, defined by first, second and third interconnected rear wall sections;

a right hand wall;

a left hand wall;

said front wall and said rear wall configured roughly parallel to each other;

said right wall and said left wall being configured roughly parallel to each other and at right angles to said front and rear walls;

said front wall connected by said first front wall section to said right hand wall and connected by said second front wall section to said left hand wall;

said rear wall connected by said first rear wall section to said right hand wall and connected by said second rear wall section to said left hand wall;

a first pair of interior walls, one interior wall opposite said right hand wall and the other interior wall opposite said left hand wall, said interior walls connected respectively on one end to said first and second front wall sections and respectively on the other end to said first and second rear wall sections;

a second pair of spaced apart opposing interior walls connected on one end to said third front wall section and on the opposite end to said third rear wall section;

said first and second pairs of interior walls dividing said storage unit into said first, second and third open top container trays;

a bottom wall having three flat bottom panels conjoined with the wall sections of said front wall, said rear wall, said right hand wall, and said pairs of interior walls;

said front, rear, right hand and left hand walls and said first and second pairs of interior walls being of the same height;

a series of formed elongated vertically extending pockets of relatively narrow and uniform width throughout their longitudinal extent in each of said right hand wall, said first pair of interior walls and said left hand wall;

said first and second container trays being located on opposite sides of said third container tray;

said third container tray being larger in volume than either of said first and second container trays;

one or more dividers insertable into a pair of opposing pockets located in the walls of said first and second trays;

each divider being of the same height as the length of each pocket;

the upper edges of said walls being provided with outwardly extending flanges of generally uniform thickness around the peripheries of said trays; and one or more cut lines provided along the top surface of said first and second pairs of said interior walls;

whereby leakage or moisture from any source in close proximity or consequently coming into contact with one or more of said container trays of the storage unit will be completely contained.

* * * * *